US005582317A

United States Patent [19]

Wermund

[11] Patent Number: 5,582,317

[45] Date of Patent: Dec. 10, 1996

[54] RECLOSABLE CONTAINER AND A METHOD OF FORMING AND ASSEMBLING A RECLOSABLE CONTAINER

[75] Inventor: Horst F. Wermund, Holzkirchen, Germany

[73] Assignee: Kraft Jacobs Suchard R&D, Inc., Munich, Germany

[21] Appl. No.: 452,268

[22] Filed: May 26, 1995

Related U.S. Application Data

[62] Division of Ser. No. 180,746, Jan. 13, 1994, Pat. No. 5,472,542.

[51] Int. Cl.[6] ..... B65D 39/00

[52] U.S. Cl. ..... 220/789; 215/320; 206/467; 220/794

[58] Field of Search ..... 215/317, 320, 215/321, 354, 355; 220/307, 212.5, 213, 308; 206/467, 469, 471

[56] References Cited

U.S. PATENT DOCUMENTS

| | | | |
|---|---|---|---|
| 2,571,227 | 10/1951 | Fong et al. . | |
| 3,055,540 | 9/1962 | Ringlen . | |
| 3,079,037 | 2/1963 | Schechter | 220/307 X |
| 3,262,602 | 7/1966 | McConnell et al. . | |
| 3,412,889 | 11/1968 | Eicholtz et al. . | |
| 3,420,397 | 1/1969 | Miller | 220/307 X |
| 3,749,277 | 7/1973 | Kinney . | |
| 4,227,625 | 10/1980 | Underwood | 220/307 |
| 4,488,658 | 12/1984 | Smith et al. . | |
| 4,562,937 | 1/1986 | Iyengar . | |
| 4,620,642 | 11/1986 | Wertz et al. . | |
| 4,643,329 | 2/1987 | Mobberley | 220/257 |
| 4,679,699 | 7/1987 | Malsbury et al. | 220/307 |
| 4,885,121 | 12/1989 | Patel . | |
| 5,129,517 | 7/1992 | Hustad | 206/467 |
| 5,181,626 | 1/1993 | Daenen et al. . | |

FOREIGN PATENT DOCUMENTS

| | | |
|---|---|---|
| 381329 | 8/1990 | European Pat. Off. . |
| 1224328 | 6/1960 | France . |
| 1274073 | 9/1961 | France . |
| 2534748 | 2/1977 | Germany . |
| 8700134.9 | 4/1987 | Germany . |
| 2278591 | 12/1994 | United Kingdom . |

*Primary Examiner*—Stephen Cronin
*Attorney, Agent, or Firm*—Scully, Scott, Murphy & Presser

[57] ABSTRACT

A reclosable, container and a method of forming and assembling the roclosable container is provided. A cup forms an interior and a top opening to provide access to the interior and a lid is releasably connected to the cup to selectively close the top opening and to form a seal with the cup to seal the interface or connection between the lid and the cup.

14 Claims, 2 Drawing Sheets

RECLOSABLE CONTAINER AND A METHOD OF FORMING AND ASSEMBLING A RECLOSABLE CONTAINER

This is a divisional of application Ser. No. 08/180,746, filed on Jan. 13, 1994, now U.S. Pat. No. 5,472,542.

BACKGROUND OF THE INVENTION

This invention generally relates to reclosable containers of the type having a cup and a removable lid; and more specifically, to containers of this type where the cup and the lid also form a seal along the connection between the cup and the lid when the lid is mounted on the cup.

Many food products are packaged and sold in reclosable containers of the type comprising a shell or cup and a lid or cap that can be removed from and then reconnected to the cup to repeatedly open and close the container. For example, cream cheese, cottage cheese, and other products are often packaged in this way.

Typically, the cup and the lid are both made of plastic and have well-defined, self-sustaining shapes, although both the cup and the lid are also slightly flexible. Normally, the cup and the lid are constructed so that when the lid is mounted in place on the cup, the flexibility and shape of the cup and the lid cooperate to hold the lid in place until a small force is intentionally applied to the lid to remove it from the cup. In use, a consumer removes the lid to open the container, removes a portion of the food product therein, and then replaces the lid to reclose the container, thereby to help maintain the freshness, taste, and aroma of the food product remaining in the container.

These containers are usually designed to accomplish several objectives simultaneously. For example, the containers are often designed so that an effective hermetic seal is formed between the lid and the cup when the lid is mounted on the cup to close the cup. This seal may be achieved by designing the lid and the cup so that when the lid is connected to the cup, the lid and cup are in pressure engagement along a line or small area extending completely around the connection or interface between the cup and the lid.

This, in turn, may be done, for example, by providing the cup with a small bead or lip extending around the perimeter of the cup, and by providing the lid with a small groove extending around the perimeter of the lid and adapted to receive the bead or lip of the cup. As the lid is placed on the cup, the lid and cup flex slightly, allowing the groove on the lid to slide toward the bead on the cup. The lid is moved further along cup to slide the bead into the groove; and as this happens, the inherent resiliency of the lid and the cup cause the lid and cup to flex back, with the bead extending into the groove, in pressure engagement with the surfaces of the lid forming that groove. This pressure engagement may form the desired seal between the cup and the lid or this engagement may be used to hold other, adjacent portions of the lid and cup together to form the desired seal.

The above-described connection between the lid and the cup also tends to hold the lid firmly on the cup. This helps to prevent the container from being opened accidently or inadvertently during normal handling of the container or in case the container is dropped.

Containers of the above-described type are also normally designed so that the lid can be repeatedly removed from and then reconnected to the cup, and this usually requires that the lid be relatively rigid. If the lid is not rigid, repeated handling of the lid may tear or deform the lid, particularly in view of the above-described firm pressure engagement between the lid and the cup.

In addition, containers of this type are commonly designed so that several containers can be stacked on top of each other. This facilitate storing and shipping the containers, as well as displaying the containers in a store or market. In order to achieve this objective, the cup or shell of the container may be made from a relatively strong, rigid material.

These prior art containers also usually have one or more thin membranes that contain printed information. This printed information may, inter alia, identify the name of the food product and the name of the manufacturer, and a membrane may be glued or molded to the lid or the cup of the container. Typically, these membranes do not serve any mechanical function.

The above-outlined design considerations sometimes conflict with each other. For instance, as previously mentioned, in order to ensure that the lid may be repeatedly removed and reconnected to the cup, it is preferred to form the lid from a relatively rigid material. In addition, in order that a multitude of containers be stacked one on top of another, it is also preferred to form the cups of the containers from a relatively rigid and thick material.

However, in order to develop a good seal between the cup and the lid, it is preferred to form the cup and lid from a more flexible material. In this way, the areas of the cup and lid that are pressed against each other to form the seal can closely conform to and fit against each other despite any small irregularities or imperfections in or on those areas. Because of these conflicting considerations, the final design of the container is a compromise.

SUMMARY OF THE INVENTION

The present invention relates to a reclosable container and to a method of forming and assembling a reclosable container. The cup forms an interior and a top opening to provide access to that interior, and the lid is releasably connected to the cup to selectively close the top opening thereof and to form a seal with the cup that seals the interface or connection between the lid and the cup. More specifically, the cup includes a bottom wall and a side wall; and this side wall includes a main portion, a supporting lip portion, a connecting portion and a sealing portion. The lid includes a base and a sealing member; and the base, in turn, includes a lower portion, a connecting portion, and a top portion.

The side wall of the cup is connected to and extends upwards from the bottom wall of the cup, and the side wall extends around the interior of the cup. In particular, the main portion of the side wall is connected to and extends upwards from the bottom wall, and the supporting lip portion of the side wall is connected to and extends generally horizontally outward from the main portion of the side wall. The connecting portion of the side wall is connected to and extends upward and outward from the supporting lip portion, and the sealing portion is connected to and extends generally horizontally outward from the connecting portion of the side wall.

The lower portion of the base of the lid sits on and extends upward from the supporting lip portion of the cup. The connecting portion of the lid base is connected to and extends upward from the lower portion of the lid base, and this connecting portion engages and is releasably connected to the connecting portion of the side wall of the cup to releasably connect the cup and the lid together. The top portion of the base is connected to and extends inward from the connecting portion of the base, and the top portion extends across and over the area inside this connecting portion. Also, the sealing member of the lid is connected to and extends generally horizontally outward from the base of the lid, and the sealing member seats against the sealing portion of the cup to form a seal between the cup and the lid extending around the top opening of the cup.

Preferably, the base of the lid is formed in an injection molding process, and this base has a relatively rigid shape, although it also is slightly flexible. The sealing member of the lid has a thin, highly flexible shape, allowing this member to form a very effective seal with the cup, and preferably this sealing member is molded to the base of the lid in an in-mold molding process. In addition, preferably, the cup of the lid is formed in an injection molding process, and this cup also has a relatively rigid, and slightly flexible shape.

Further benefits and advantages of the invention will become apparent from a consideration of the following detailed description given with reference to the accompanying drawings, which specify and show preferred embodiments of the invention.

DETAILED DESCRIPTION OF THE PREFERRED EMBODIMENTS

Figure 1:
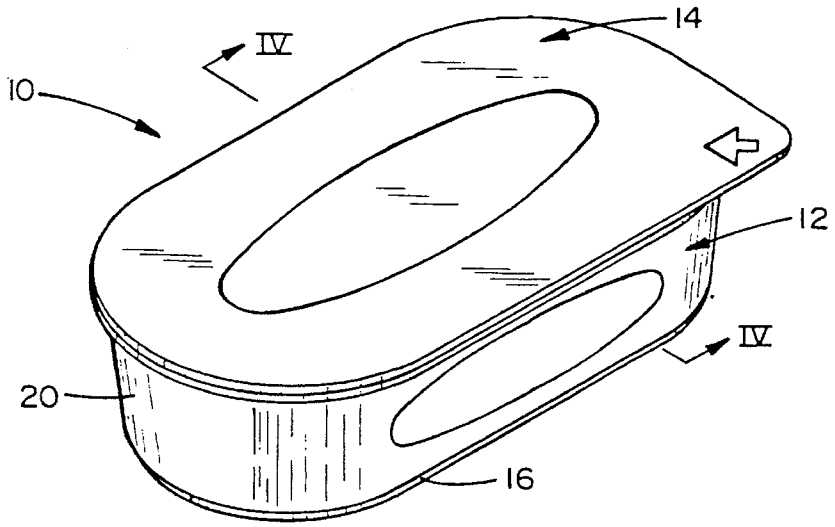
FIG. 1 shows a container embodying the present invention.
Figure 2:
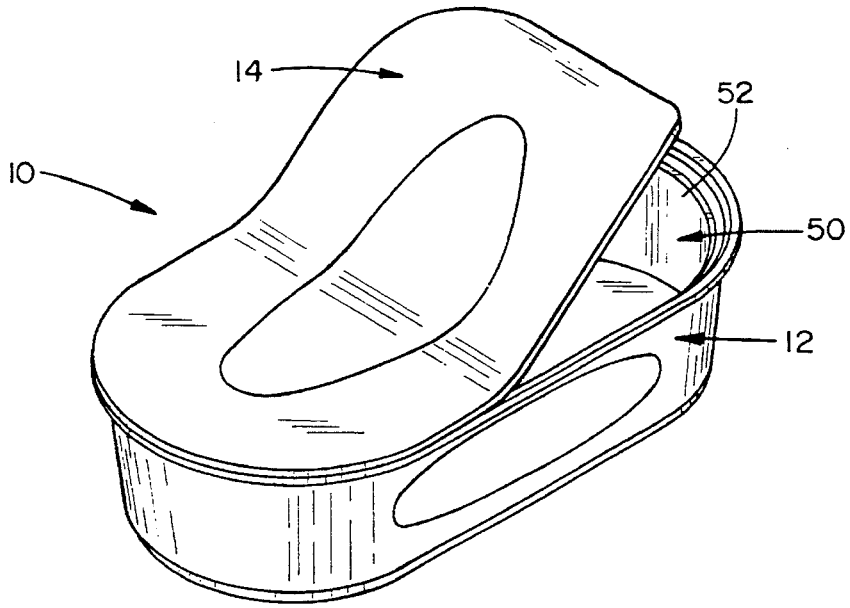
FIG. 2 illustrates the container partially opened.
Figure 3:
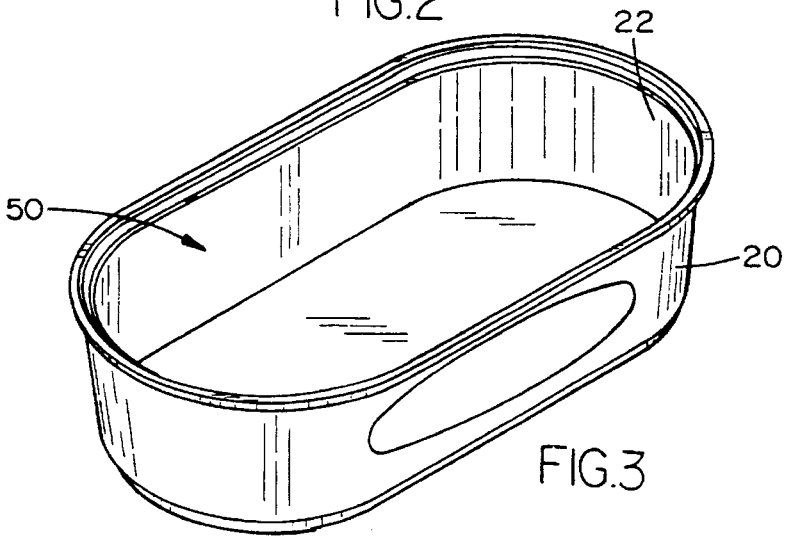
FIG. 3 shows the container with the lid removed.

The drawings illustrate container 10 generally comprising cup or shell 12 and lid or cap 14. Generally, cup 12 includes bottom wall 16 and side wall 20; and side wall 20 includes main portion 22, supporting lip portion 24, connecting portion 26, and sealing portion 30. Lid 14 includes base 32 and sealing member 34; and base 32 includes lower portion 36, connecting portion 40, and top portion 42. Preferably, connecting portion 26 of cup 12 includes annular bead 44, and connecting portion 40 of base 32 includes annular groove 46.

Bottom and side walls 16 and 20 of cup 12 are connected together and form an interior 50 for holding a food product, and a top opening 52 to provide access to that interior and the food product therein. More specifically, main portion 22 of side wall 20 is connected to bottom wall 16 and extends upward therefrom, and supporting lip portion 24 of the side wall is connected to and extends generally horizontally outward from main portion 22. Connecting portion 26 of side wall 20 is connected to and extends upward and outward from supporting lip portion 24, and sealing portion 30 is connected to and extends generally horizontally outward from connecting portion 26.

With the embodiment of container 10 illustrated in the drawings, bottom wall 16 has a generally flat, oval shape, and side wall 20 extends completely and continuously around the interior 50 of the container. Side wall 20 and each of the portions 24, 26, 30, and 32 thereof have a generally oval or annular shape when viewed from the top. Preferably, cup 12 has a relatively rigid, self-sustaining shape, although at least side wall 20 of the cup is slightly flexible. Moreover, side wall 20 and bottom wall 16 are preferably integrally connected together, and even more preferably, cup 12 is formed in an injection molding process. Any suitable mold and any suitable plastic may be used to form cup 12.

Lid 14 is releasably connected to cup 12 to selectively close top opening 52 thereof and to form a seal with the cup that seals the interface or connection between the lid and the cup. More specifically, base 32 of lid 14 engages cup 12 and releasably connects the lid thereto, and the base extends across top opening 52, closing that opening. At the same time, sealing member 34 of lid 14 is connected to and extends generally horizontally outward from base 32, and the sealing member seats against sealing portion 30 of cup 12 to form a seal between the lid and the cup that extends around top opening 52.

Even more specifically, lower portion 36 of base 32, specifically lower edge 54, sits on and extends upwards from supporting lip 24 of cup 12, and preferably edge 54 of base 32 sits on supporting lip 24 over the entire length or circumference of lip 24. Connecting portion 40 of base 32 is connected to and extends upward from lower portion 36; and in a manner more fully discussed below, connecting portions 26 and 40 of cup 12 and lid 14 cooperate to releasably connect the cup and lid together. Preferably, connecting portion 40 abuts against and is in pressure engagement with connecting portion 26 of cup 12 over the entire length or circumference of connecting portion 26. Top portion 42 of base 32 is connected to and extends inward from connecting portion 40, across and over the area inside connecting portion 40.

With the preferred embodiment of lid 14, lower portion 36 and connecting portion 40 both have a generally annular shape when viewed from the top; and top portion 42 has a generally flat oval shape and extends completely across the space inside lower portion 36 and connecting portion 40, covering that area. In addition, lower portion 36, connecting portion 40, and top portion 42 are integrally connected together, and preferably these portions 36, 40, and 42 are all integrally formed together also in an injection molding process. Any suitable mold and any suitable plastic may be used to form portions 36, 40, and 42.

Sealing member 34 is connected to and extends generally horizontally outward from base 32; and member 34 is adapted to seat against sealing portion 30 of cup 12, when the cup and lid 14 are connected together, to form a seal between the cup and the lid that extends around the top opening of the cup. Preferably, sealing member 34 is relatively flexible so that the sealing member closely conforms to and seats against the top surface of sealing portion 30 of cup 12 despite any irregularities or imperfections in that surface. Further, as illustrated in the drawings, preferably sealing member 34 has a thin, flat shape and extends completely over the top portion 42 of base 32.

Sealing member 34 may be made in any suitable manner and from any suitable material. For example, sealing member 34 may be made in a manner similar or identical to the process currently used to form the above-mentioned thin membranes that are applied to containers of the general type of container 10, to display printed information. These membranes are commonly made from polypropylene and formed in an extrusion molding process.

In addition, sealing member 34 may be connected to base 32 in any suitable manner However preferably sealing member 34 and base 32 are connected together in an in-mold molding technique in a manner similar or identical to the way in which the above-mentioned thin, printed membranes are currently applied to containers of the general type of container 10. For instance, sealing member 34 may be placed in the mold in which base 32 is formed, and then a plastic may be injected into that mold to form base 32. That plastic forms base 32 and, at the same time, securely bonds to sealing member 34. In addition, if desired, information or data may be printed on the outside surface of sealing membrane 34.

Figure 4:
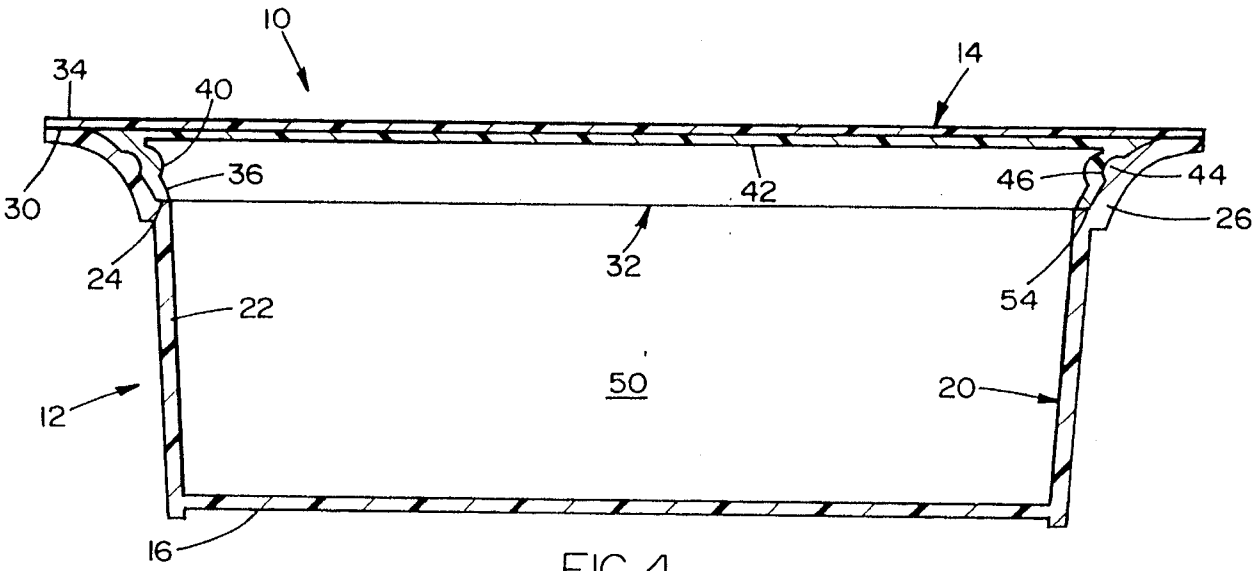
FIG. 4 is a cross-sectional view of the container, generally taken along line IV—IV of FIG. 1.
Figure 5:
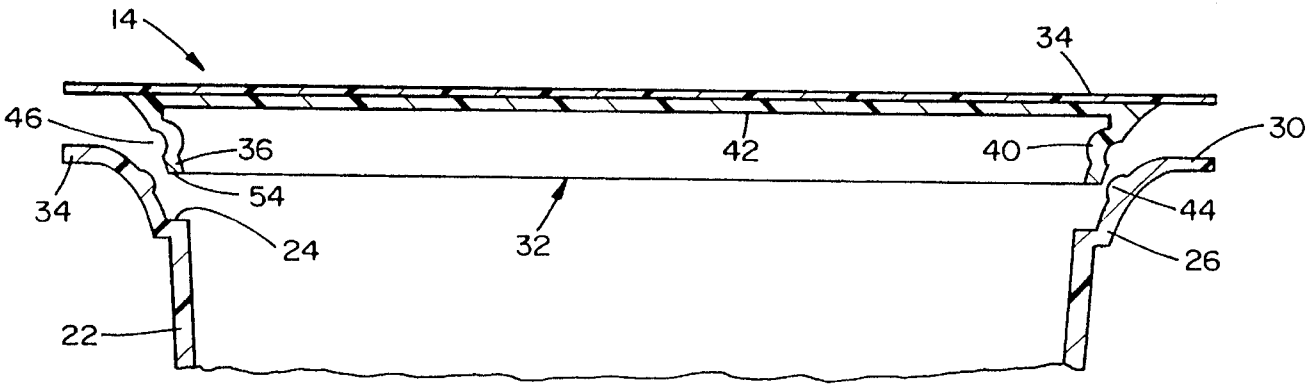
FIG. 5 is a cross-sectional view of the upper portion of the container, and showing the lid and the cup of the container slightly spaced apart.

As previously mentioned, connecting portions 26 and 40 are provided to releasably connect cup 12 and lid 14 together, and preferably this is done by means of a connection of the type that is commonly referred to as a snap lock or a snap fit. To elaborate, connecting portions 26 and 40 are constructed so that when lid 14 is mounted on cup 12, in the position illustrated in FIGS. 1 and 4, the inherent resiliency of base 32 slightly urges connecting portion 40 outward, and the inherent resiliency of side wall 20 slightly urges connecting portion 26 inward. As a result, connecting portions 26 and 40 are urged against each other, and bead 44 is biased into groove 46. The inherent resiliency of base 32 and side wall 20 help to maintain bead 44 in groove 46, and the abutting contact between bead 44 and the surfaces of connecting portion 40 that form groove 46 inhibit upward movement of the lid 14, away from the closed or locked position shown in FIGS. 1 and 4.

To open container 10, a firm upward force is applied to lid 14 to pull the lid upward and away from cup 12. This force tends to pull groove 46 upward relative to bead 44, and the engagement between the bead and the surfaces of connecting portion 40 that form the lower portion of groove 46 causes connecting portions 26 and 40, respectively, to flex outward and inward slightly. This flexing continues until groove 46 is pulled away from bead 44; and once this happens, lid 14 is easily pulled further away from cup 12, and the lid and the cup flex back to respective original shapes.

To mount lid 14 on cup 12, base 32 of the lid is moved downward, into the area inside connecting portion 26 of the cup. As this is done, connecting portion 40 of lid 14 engages connecting portion 26 of cup 12; and further downward movement of lid 14 causes connecting portions 26 and 40, respectively, to flex slightly outward and inward. Lid 14 is moved further downward until groove 46 reaches bead 44; and when this happens, connecting portions 40 and 26, due to their inherent resiliency, slightly flex outward and inward respectively, forcing bead 44 into groove 46 and connecting or locking lid 14 and cup 12 together.

Preferably, when lid 14 is connected or locked onto cup 12 in the above-described manner, connecting portions 26 and 40 hold the lid and the cup together with a firm pressure engagement between sealing member 34 of the lid and sealing portion 30 of the cup, ensuring that an effective seal is produced by member 34 and portion 30. In addition, when lid 14 is connected to cup 12, the lid seats directly on supporting lip 24 of cup 12, and any load placed on the lid is transmitted directly to the supporting lip and side wall 20 of the cup. Side wall 20 may be, and preferably is, designed and constructed so that it may support a substantial load, and thus a multitude of containers 10 may be stacked on top of each other.

In accordance with the present invention, the lid of the container is separated into two parts—base 32 and sealing member 34—and each of these parts is used to accomplish a respective objective. In particular, base 32 is used to connect the lid to cup 12, and sealing member 34 is used to form a seal with the cup. The base and the sealing member may each be designed and constructed separately to achieve its respective objective without compromising one object for the other. Moreover, base 32 and sealing member 34 may each be made and then securely connected together using known, established procedures.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

I claim:

1. A reclosable container comprising:

a cup including a bottom wall and a side wall and forming an interior and a top opening to provide access to the interior, the side wall being connected to and extending upward from the bottom wall and extending around said interior, and including i) a main portion connected to and extending upward from the bottom wall, ii) a supporting lip portion connected to and extending outward generally horizontally from the main portion, iii) a connecting portion connected to and extending upward and outward from the supporting lip portion, and iv) a sealing portion connected to and extending generally horizontally outward from the connecting portion; and a lid releasably connected to the cup to selectively close the top opening thereof, and including a base and a sealing member, wherein the base is made of a relatively rigid material to form a strong connection between the lid and the cup, and the sealing member is made of a relatively flexible material to form an effective seal between the lid and the cup, and wherein the sealing member is securely bonded to the base;

the base including (i) a lower portion, (ii) a connecting portion and (iii) a top portion, the lower portion sitting on and extending upward from the supporting lip portion of the cup, the connecting portion being connected to the lower portion and to the top portion, extending upward from said lower portion and extending downward from said top portion, and engaging and releasably connected to the connecting portion of the cup to releasably connect the cup and the lid together, and the top portion being connected to and extending inward from the connecting portion of the base, and closing the top opening of the cup, the sealing member being connected to and extending generally horizontally outward from the top portion of the base, and seating against the sealing portion of the cup to form a seal between the cup and the lid extending around the top opening of the cup.

2. A reclosable container according to claim 1, wherein the base and the sealing member of the lid are molded together.

3. A reclosable container according to claim 2, wherein the base is formed in an injection molding process.

4. A reclosable container according to claim 3, wherein the sealing member has a flat shape and is highly flexible to facilitate forming the seal between the lid and the cup.

5. A reclosable container according to claim 4, wherein the main portion, the lip portion, the connecting portion, and the sealing portion of the cup are integrally molded together.

6. A reclosable container according to claim 1, wherein:

the connecting portions of the side wall and the base are both flexible;

one of the connecting portions forms a peripheral groove, and the other of the connecting portions form a peripheral bead located in said peripheral groove; and the flexibility of the side wall and the base help to hold the bead in the groove and inhibit upward movement of the lid away from the cup.

7. A reclosable container according to claim 1, wherein the sealing member of the lid is separable from the sealing portion of the cup to allow the sealing member to be pulled away from the sealing portion.

8. A reclosable container according to claim 1, wherein the top portion of the base of the lid has a generally flat shape; and the sealing member of the lid has a flat shape and extends over, and adjoins, the top portion of the base of the lid.

9. A reclosable container comprising:

a cup including a bottom wall and a side wall and forming an interior and a top opening to provide access to the interior, the side wall extending around said interior and including i) a main portion connected to and extending upward from the bottom wall, ii) a supporting lip portion connected to and extending outward generally horizontally from the main portion, iii) a connecting portion connected to and extending upward and outward from the supporting lip portion, and iv) a sealing portion connected to and extending generally horizontally outward from the connecting portion; and a lid to selectively close the top opening of the cup, and including a base and a sealing member, wherein the base is made of a relatively rigid material to form a strong connection between the lid and the cup, and the sealing member is made of a relatively flexible material to form an effective seal between the lid and the cup, and wherein the sealing member is securely bonded to the base;

the base including (i) a lower portion, (ii) a connecting portion and (iii) a top portion, the lower portion being adapted to sit on the supporting lip portion of the cup, the connecting portion being connected to the lower portion and to the top portion, extending upward from said lower portion and extending downward from said top portion, and being adapted to engage the connecting portion of the cup and releasably connect the cup thereto, and the top portion being connected to and extending inward from the connecting portion of the base, to close the top opening of the cup, the sealing member being connected to and extending generally horizontally outward from the top portion of the base, and adapted to seat against the sealing portion of the cup to form a seal between the cup and the lid extending around the top opening of the cup.

10. A reclosable container according to claim 9, wherein:

the base and the sealing member of the lid are molded together; and the base is formed in an injection molding process.

11. A reclosable container according to claim 10, wherein:

the sealing member has a flat shape and is highly flexible to facilitate forming a seal between the lid and the cup; and the main portion, the lip portion, the connecting portion, and the sealing portion of the cup are integrally molded together.

12. A reclosable container according to claim 11, wherein:

the connecting portions of the side wall and the base are both flexible;

one of the connecting portions forms a peripheral groove, and the other of the connecting portions forms a peripheral bead adapted to fit into said peripheral groove; and when the lid is connected to the cup, the flexibility of the side wall and the base help to hold the bead in the groove and inhibit upward movement of the lid away from the cup.

13. A reclosable container according to claim 9, wherein the sealing member of the lid is adapted to separate from the sealing portion of the cup to allow the sealing member to be pulled away from the sealing portion.

14. A reclosable container according to claim 9, wherein the top portion of the base of the lid has a generally flat shape; and the sealing member of the lid has a flat shape and extends over, and adjoins, the top portion of the base of the lid.

* * * * *